United States Patent [19]

Fukunaga et al.

[11] Patent Number: 4,603,314

[45] Date of Patent: Jul. 29, 1986

[54] INDUCTOR

[75] Inventors: Kazuo Fukunaga; Minoru Higurashi; Motoyoshi Fujita, all of Chiba; Eiichi Suga, Tokyo; Masao Shigeta; Norio Sato, both of Chiba, all of Japan

[73] Assignee: TDK Corporation, Tokyo, Japan

[21] Appl. No.: 542,948

[22] Filed: Oct. 18, 1983

[30] Foreign Application Priority Data

| | | | |
|---|---|---|---|
| Oct. 26, 1982 | [JP] | Japan | 57-188018 |
| Oct. 26, 1982 | [JP] | Japan | 57-161888[U] |
| Oct. 26, 1982 | [JP] | Japan | 57-161889[U] |
| Oct. 26, 1982 | [JP] | Japan | 57-161890[U] |

[51] Int. Cl.[4] ..... H01F 15/02; H01F 27/26

[52] U.S. Cl. ..... 336/65; 29/605; 29/609; 336/178; 336/198; 336/210; 336/213

[58] Field of Search ..... 336/65, 178, 213, 198, 336/208, 210, 98, 229, 92; 29/605, 609

[56] References Cited

U.S. PATENT DOCUMENTS

| | | | |
|---|---|---|---|
| 1,775,600 | 9/1930 | Reis | 336/178 X |
| 1,784,833 | 12/1930 | Hagemann | 336/198 |
| 2,216,863 | 10/1940 | Visman | 336/198 |
| 2,290,680 | 7/1942 | Franz | 336/178 X |
| 2,367,591 | 1/1945 | McAllister | 336/210 X |
| 2,446,999 | 8/1948 | Camilli | 336/229 X |
| 2,780,785 | 2/1957 | Ford | 336/213 |
| 2,946,973 | 7/1960 | Lufey | 336/213 |
| 2,963,670 | 12/1960 | Spencer et al. | 336/198 |
| 2,999,215 | 9/1961 | Lufey et al. | 336/213 |
| 4,443,777 | 4/1984 | Koike | 336/65 |

FOREIGN PATENT DOCUMENTS

| | | | |
|---|---|---|---|
| 686052 | 1/1940 | Fed. Rep. of Germany | 336/178 |
| 841351 | 5/1939 | France | 336/213 |
| 57-106010 | 7/1982 | Japan . | |
| 57-106011 | 7/1982 | Japan . | |
| 673267 | 6/1952 | United Kingdom | 336/178 |

*Primary Examiner*—Thomas J. Kozma

*Attorney, Agent, or Firm*—Armstrong, Nikaido, Marmelstein & Kubovcik

[57] ABSTRACT

The improved structure of an inductor with an amorphous sheet core and a winding has been found. A core assembly has a pair of housing halves made of non-magnetic material with U-shaped track, in which a laminated amorphous sheet is mounted. The ends of the halves are inserted in a winding so that the ends of the cores abut with each other directly or through a gap spacer. The core halves are pressed by spring action to assemble the inductor. The core halves are produced by the steps of winding an amorphous sheet to a coil, inserting the coil in the track of the housing, and impregnating the coil with plastics.

2 Claims, 13 Drawing Figures

INDUCTOR

BACKGROUND OF THE INVENTION

The present invention relates to an inductor device, in particular, relates to such a device which has a laminated toroidal magnetic core made of amorphous alloy and a winding wound on that magnetic core. The present invention is applicable, for instance, to a choke coil and a transformer.

A magnetic core for a choke coil or a transformer is conventionally made of ferrite material. And, lately, amorphous material is used for a core of a choke coil and/or a transformer instead of a ferrite material. Amorpuous material has the nature that the excellent rectangular B-H characteristics are obtained, the coercive force is extremely small, the loss in a core is small and so a small size of a transformer is obtained with low temperature-rise. Therefore, when an amorphous core is used as a core of a power transformer of an electric appliance, the power efficiency of the transformer is improved, and the wide range of voltage control and the stable temperature characteristics are obtained.

The amorphous material is usually shaped in a long sheet, or a ribbon, which is laminated or wound to a toroidal core.

However, a prior toroidal core has the disadvantages that the winding operation of a winding is difficult because of the toroidal shape of the core, it can not be used as an inductor which passes not only alternate current but also DC current with an air gap in a magnetic path.

The structure of FIG. 1 has been proposed for overcoming said disadvantages. In FIG. 1, the laminated toroidal core 1 is divided to two core halves 101 and 102, and an air gap G is provided between the two core halves. The structure of FIG. 1 has the advantages that the winding operation of a winding 2 is easy since the winding 2 may be wound on a bobbin 3 to which the core halves 101 and 102 are inserted, and that the magnetic characteristic are adjustable because of the presence of an air gap G. The inductor of FIG. 1 is manufactured as shown in FIGS. 2A and 2B, in which a loop magnetic core 1 is first produced as shown in FIG. 2A by winding a sheet of amorphous material, then, the loop core is cut to two core halves 101 and 102 as shown in FIG. 2B, then, those core halves are inserted into a bobbin 3 which has a winding 2.

However, the structure of FIGS. 2A and 2B has the disadvantages that the cut face 101*a*, 102*a* is not sufficiently smooth because of the cutting operation. Some sheets are even removed from the laminated body by the cutting operation. Because of the rough cut face, the length of an air gap G cannot be accurate. Further, because of the spring action of a core itself, the shape of the toroidal core is deformed. The deformation of the core shape changes the length of the air gap G, and then, even deteriorates the magnetic characteristics of the inductor itself. The air gap G has usually the length of 10–500 microns which must be very accurate, and that accuracy cannot be obtained by a prior producing method of FIGS. 1, 2A and 2B.

SUMMANY OF THE INVENTION

It is an object, therefore, of the present invention to overcome the disadvantages and limitations of a prior inductor which has amorphous core by providing a new and improved structure of an inductor.

It is also an object of the present invention to provide an inductor in which no particular jig for assembling the inductor is necessary, the accurate shape of the core is held, and the accurate air gap in the core is obtained.

The above and other objects are attained by an inductor having a pair of core halves each having a substantially U-shaped non-magnetic housing cross section of which is also substantially in U-shaped to provide a track, a laminated magnetic core with a plurality of thin tapes inserted in said housing, extreme ends of said core halves facing with each other through a non-magnetic gap spacer; means for fixing laminated cores in said housing; and a winding provided around said core halves so that the winding interlinks with the core.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1:
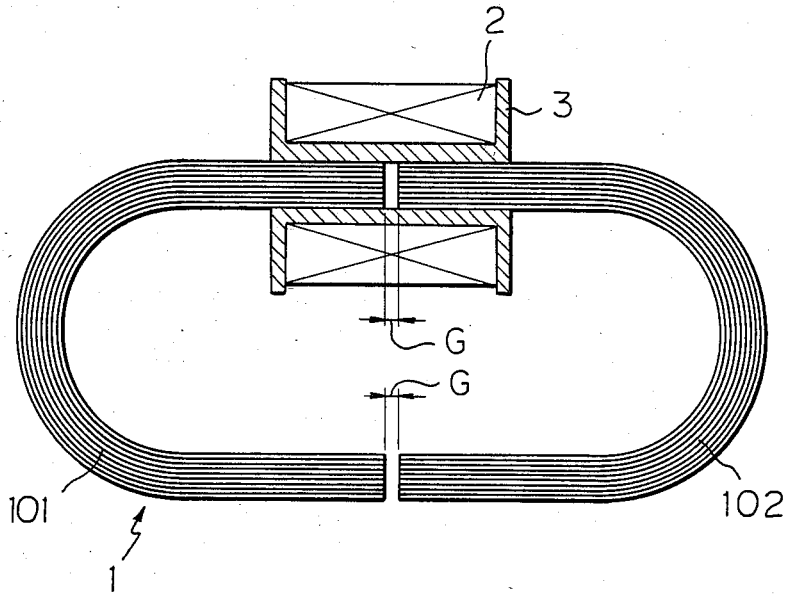
Fig. 1 PRIOR ART
FIG. 1 is a cross sectional view of a prior inductor.
Figure 2A:
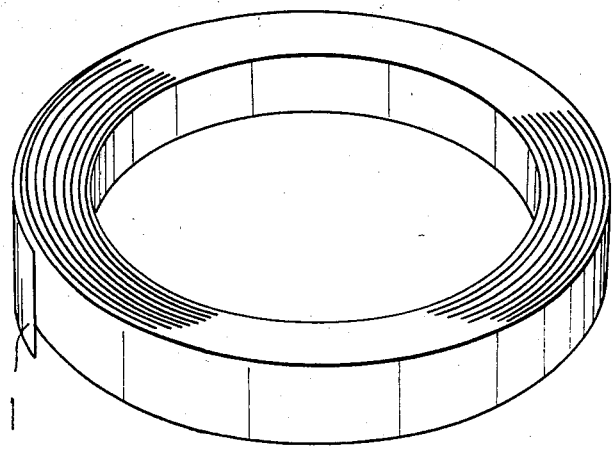
Fig. 2 A PRIOR ART
FIGS. 2A and 2B show manufacturing process of the inductor of FIG. 1, FIGS. 3A through 3E show the manufacturing process of the inductor according to the present invention.
Figure 2B:
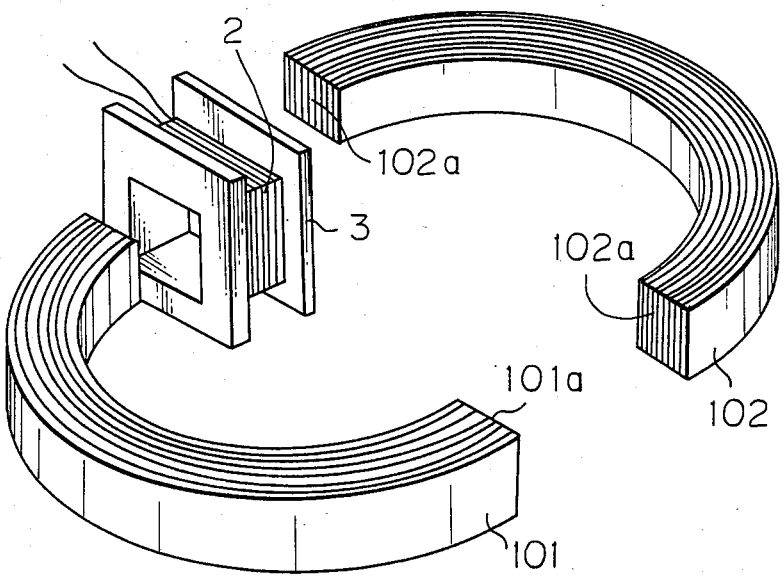
Fig. 2 B PRIOR ART
Figure 3A:
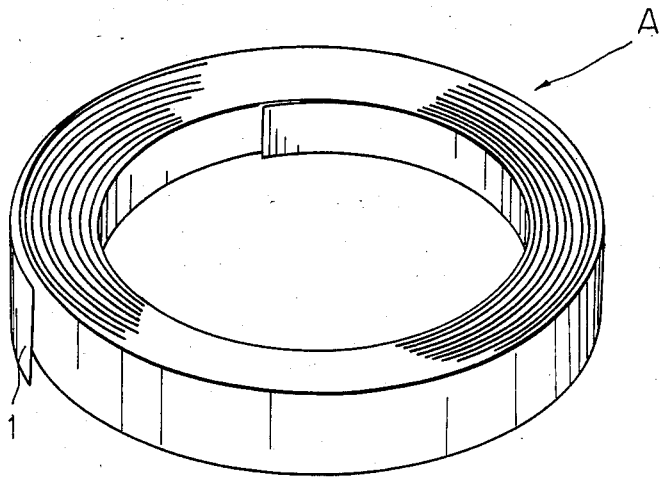
Figure 3B:
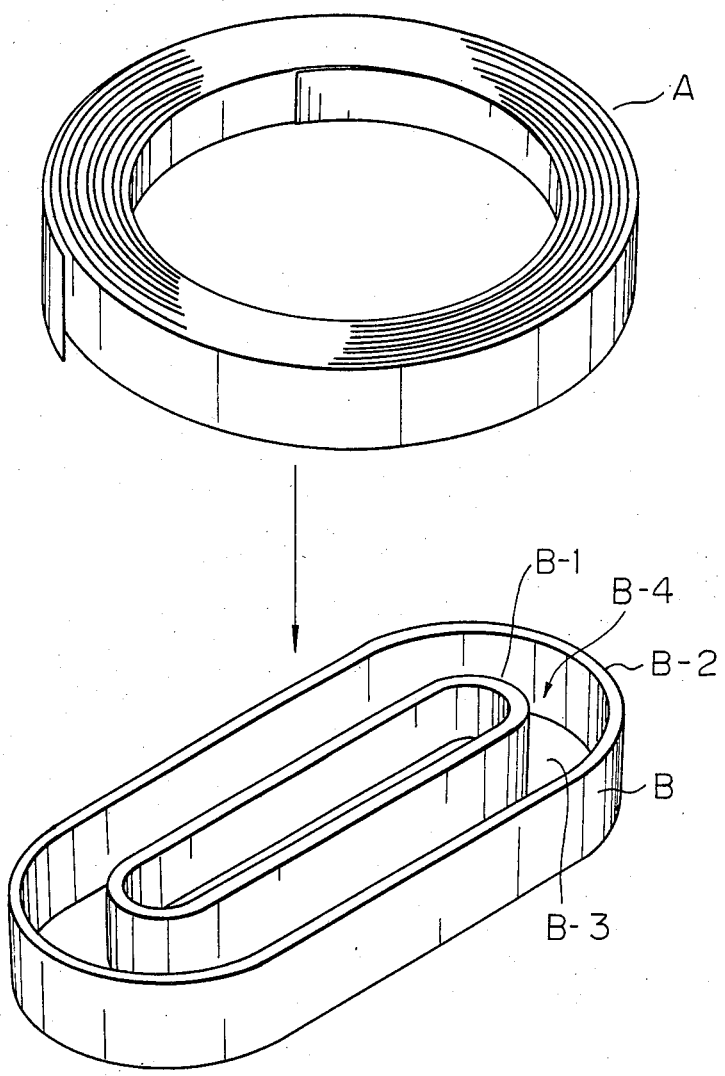

The manufacturing process of the inductor according to the present invention is described in accordance with FIGS. 3A through 3E. First, a coil or a loop A of amorphous alloy is obtained as shown in FIG. 3A by winding an amorphous sheet of an amorphous tape. Then, the coil A is mounted in a trench or a track of a housing B which is made of non-magnetic material like plastics and has any desired shape which is for instance elliptic or the combination of rectangular shape and arcs.

Figure 3C:
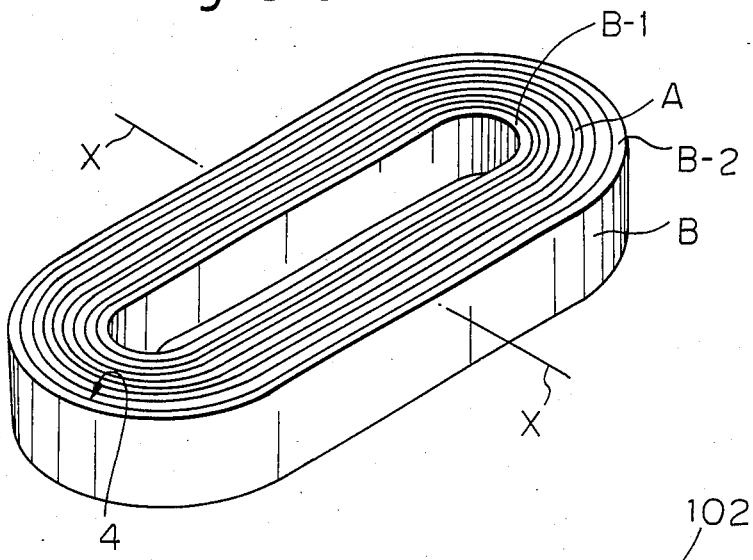

The housing B has the inner wall B-1, the outer wall B-2 and the bottom wall B-3. The elongated empty space or a track B-4 is provided among those walls, and the amorphous coil A is mounted in that space B-4 as shown in FIG. 3C. Therefore, the housing B functions as the jig for defining the shape of the amorphous coil A, and it should be noted that the deformation of the amorphous coil A by the elasticity of the coil itself is completely prevented. It may be possible to give the coil A a heat process when the coil A is mounted in the housing B so that the shape of the coil A conforms with the shape of the empty space B-4. The coil A is fixed tightly in the housing B by impregnating plastics (or vanish) into the coil A.

Figure 3D:
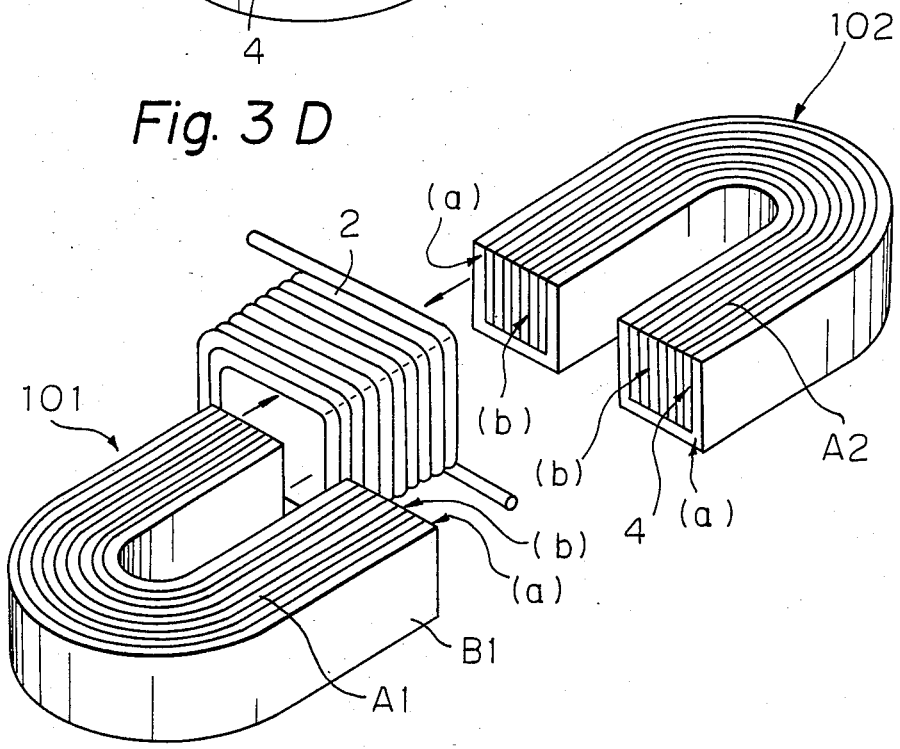

In the next step, the assembly of the coil A and the housing B is cut along the predetermined line X—X, then, a pair of core halves 101 and 102 are obtained as shown in FIG. 3D. The first core half 101 has the first housing half B1 and the first coil half A1, and the second core half 102 has the second housing half B2 and the second coil half A2. It should be noted that the end face (a) of the housing halves (B1, B2) is located on the same plane as that of the end face (b) of the laminated amorphous coil halves (A1, A2).

Figure 3E:
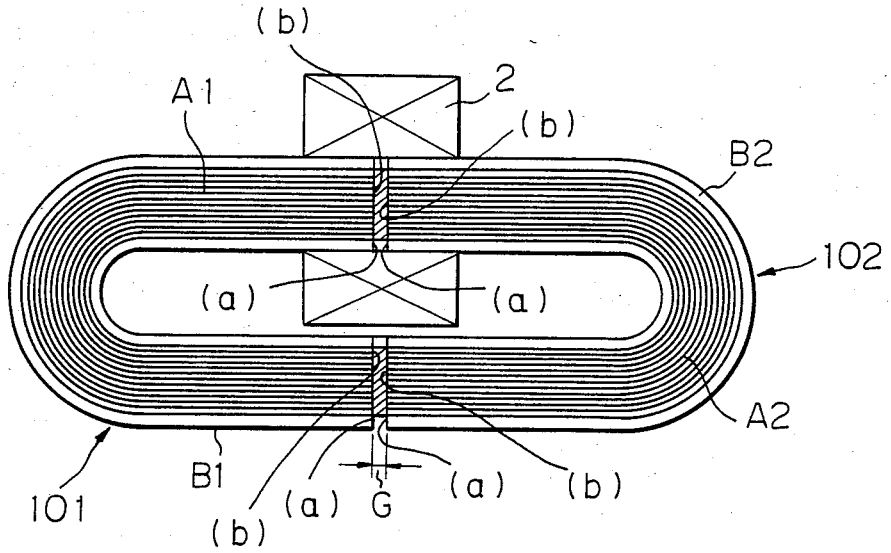

In the next step, the end of each core half is inserted into the winding 2 so that the ends of the amorphous coils confront with each other. In this case, a gap spacer made of non-magnetic material is inserted between the ends of the core halves so that the gap G is provided in the magnetic path. FIG. 3E shows the assembled inductor having the winding 2 and a pair of core halves 101 and 102, together with the gaps G.

In some modifications, the core halves 101 and 102 are pressed together by a spring (not shown), and, the opening of each housing halves may be covered with a non-magnetic cover.

The structure of the present inductor shown in FIGS. 3A through 3E has the following advatages.

(1) The end of the core halves is very flat, and therefore, the length of the gap G can be very accurate.

(2) The winding operation of the winding 5 is simple, since the winding is provided separately, but no winding operation on a toroidal core is necessary.

(3) The deformation of the laminated core does not occur since the cores are fixed rigidly in the housing through impregnation of plastics.

(4) The non-magnetic housing B doubles as a bobbin of the winding 5. Therefore, no particular bobbin for the winding 5 is necessary.

Figure 4:
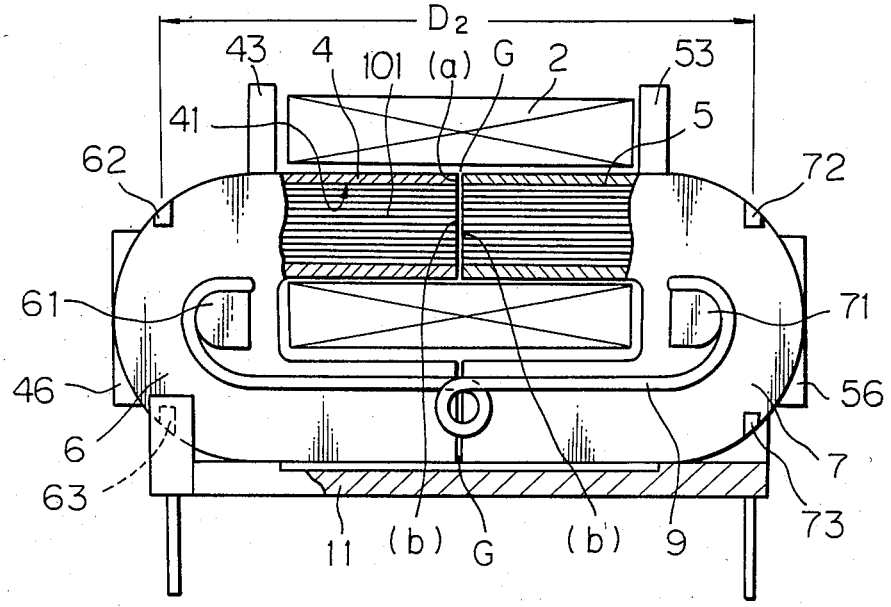
FIG. 4 is the vertical view with partially fragmentary portion of the modification of the inductor of FIGS. 3A through 3E.
Figure 5:
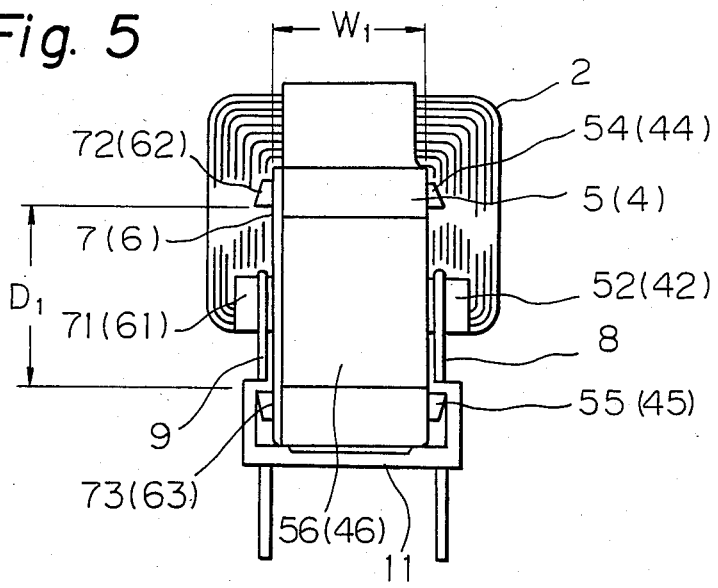
FIG. 5 is the side view of the inductor of FIG. 4.
Figure 6:
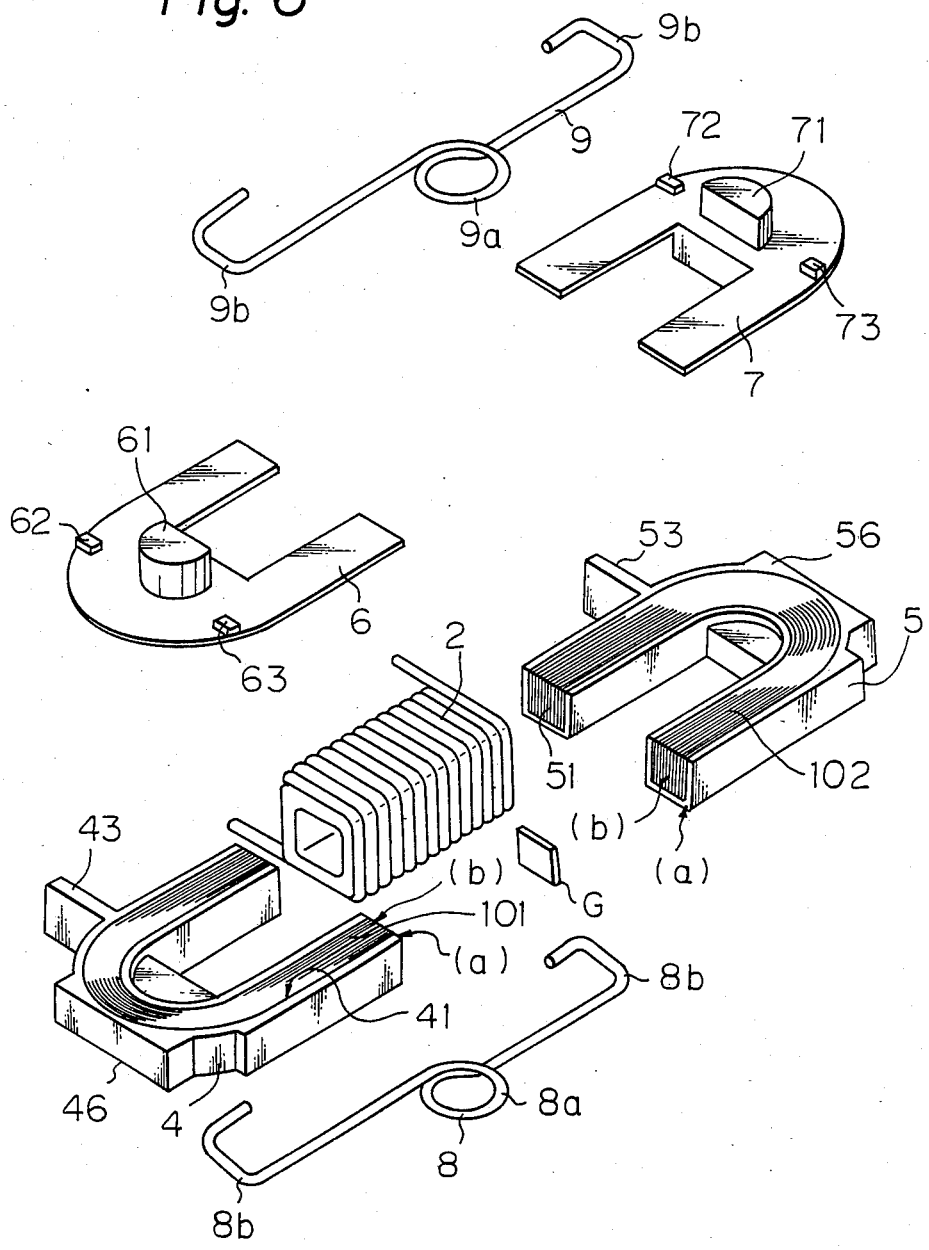
FIG. 6 is the disassembled view of the inductor of FIG. 4.

Now, the practical embodiment of the present inductor is described in accordance with FIGS. 4 through 6, in which FIG. 4 is the plane view, FIG. 5 is the side view, and FIG. 6 is the disassembled perspective view. In those figures, the same reference numerals as those of FIGS. 3A through 3E show the same members as those of previous figures. In FIGS. 4 through 6, the reference numerals 4 and 5 are housing halves for mounting magnetic core halves, 6 and 7 are covers for covering the opening of the housing halves 4 and 5. The numeral 8 and 9 are springs for attaching together the pair of core halves. The numeral 11 is the holder for mounting the present inductor on a printed circuit board (not shown). The holder 11 in the present embodiment holds the inductor horizontally.

Each of the housing halves 4 and 5 has the U-shaped elongated room or track 41 or 51. The end of said elongated room has open face (a). The amorphous coils are mounted in said rooms 41 and 51 to provide the pair of core halves 101 and 102. The end (b) of the core halves located on the same plane as that of the end (a) of the housing halves. The core halves 101 and 102 may be impregnated with plastics for fixing the laminated core sheets in the room. In the above structure, the laminated core sheets are completely fixed in the housing half. The core halves are attached together through a gap spacer G which is made of non-magnetic material and has the predetermined thickness which defines the gap length.

One leg of the core half 101 is inserted into the winding 2, which also receives the leg of the other core half 102, so that those core halves are attached together through the non-magnetic gap spacer G. The projections 43 and 53 which project outside of the housing halves 4 and 5 function to define the end of the winding 2. That is to say, those projections function substantially as a bobbin for the winding 2.

The pair of core halves are pressed together by the spring action of the springs 8 and 9, each of which is merely an elongated bar, having a center loop (8*a*, 9*a*), and a pair of end arcs (8*b*, 9*b*). In order to engage with the end arcs (8*b*, 9*b*) of the springs (8, 9), the housing halves 4 and 5 have the posts 42 and 52, respectively, and the covers 6 and 7 have also the posts 61 and 71, respectively. The cross section of those posts is in arc-shaped in order to be engaged with the end arcs of the springs. Those posts extends in the direction perpendicular to the plane defined by the core halves.

Since the core halves together with the winding are assembled merely by engaging the springs with the posts, the present inductor can be assembled very simply. Further, the common assembly process is applicable for every gap length, and the gap length can be held constant and accurate for a long time.

Figure 7:
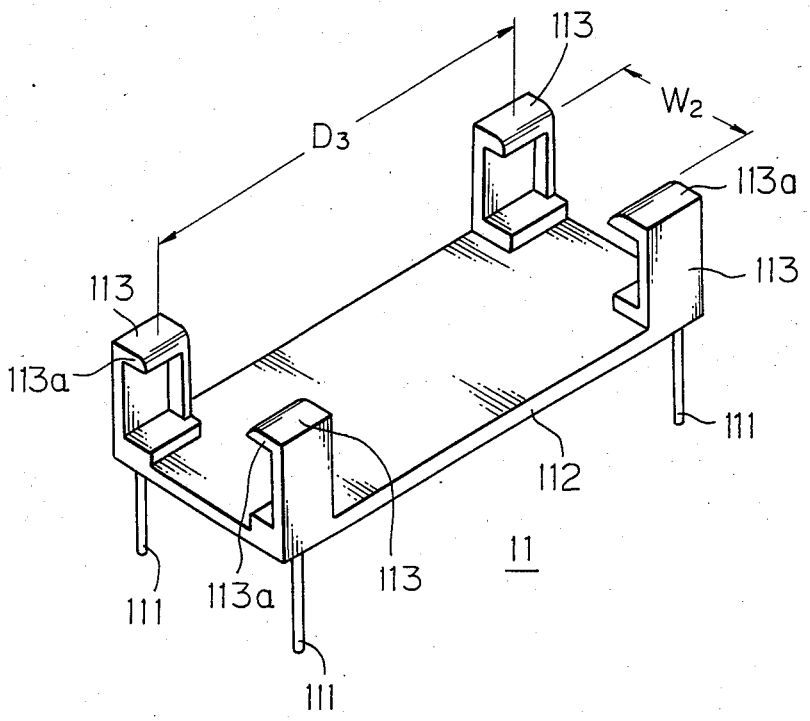
FIG. 7 is the perspective view of the holder for the inductor of FIG. 4.

FIG. 7 shows a holder which fixes the present inductor on a printed circuit board (not shown). The holder 11 in FIG. 7 has the bottom wall 112 which has a plurality of coupling pins 111 for electrical coupling of the inductor with an external circuit. The holder 11 has also a clip 113 at four corners of the bottom wall 112. Each clip 113 is made of elastic material like plastics, and is substantially in U-shaped having a pair of parallel arms 113*a*. On the other hand, the housing halves 4 and 5 have small projections (44, 45) and (54, 55), respectively, and the covers 4 and 5 have also small projections (62, 63), and (72, 73), respecrively, so that those projections engage with the U-shaped clips 113. Further, the housing halves 4 and 5 have a pair of flat portions 46 and 56 outside of the arc portions.

The length $D_2$ between the projections (62 and 72), (63 and 73), (44 and 45), or (54 and 55) is substantially the same as the longer length $D_3$ between said clips 113. The shorter length $W_2$ between the clips 113 of the holder 11 is a little smaller than the length $W_1$ which is the thickness of the inductor assembly (see FIG. 5).

When the inductor assembly is pushed on the holder 11, the clips 113 of the holder 11 engage with the projections (45, 55, 63, 73) or (44, 54, 62, 72), then, the inductor is fixed on the holder 11 by the spring action of the clips 113.

Figure 8:
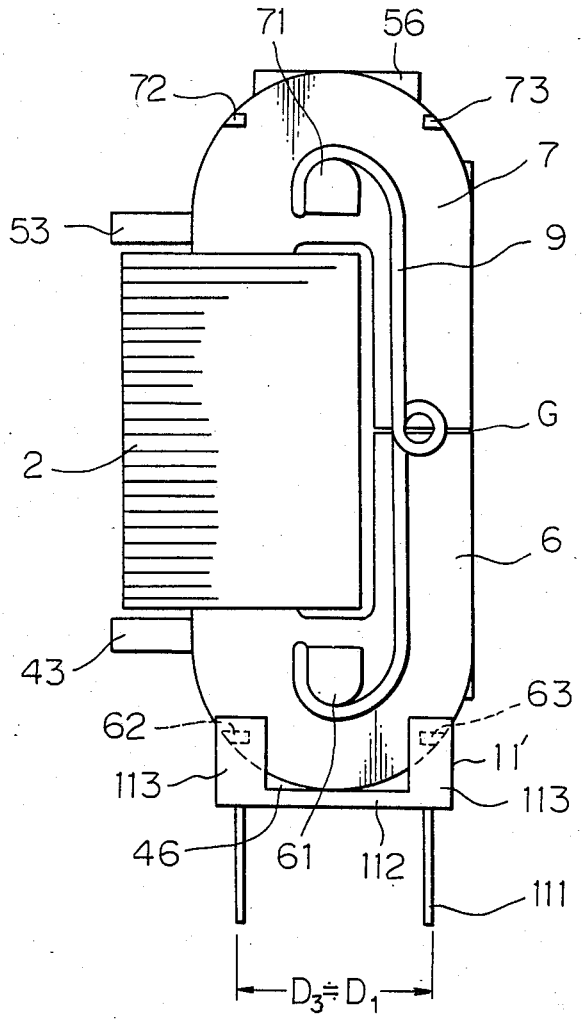
FIG. 8 is the modification of the inductor according to the present invention.

FIG. 8 shows another holder 11', which holds the inductor vertically. In this case, the length $D_3$ between the clips 113 is substantially the same as the length $D_1$ between the projections (see FIG. 5). Accordingly, it should be appreciated that the present inductor may be mounted not only horizontally but also vertically merely by selecting a holder.

Although the above embodiments show the inductor which has only one winding, the present invention is applicable to a transformer which has more than two windings.

As described above, the present invention provides an inductor which has a laminated amorphous sheet core, with a gap in a magnetic path. The winding on the core is accomplished simply by preparing said winding separately, and inserting the legs of the core halves into the winding. Thus, an inductor or a transformer having an amorphous core is manufactured simply and economically.

From the foregoing, it will now be apparent that a new and improved inductor has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. An inductor comprising:

a pair of core halves each core half comprising a housing having a recess wherein the bottom surface thereof is U-shaped and the cross section thereof is also in U-shaped, each of said core halves further having a first projection, second projections, and a third projection, wherein said first and second projections extend outwardly from said bottom surface of said housing, and said third projection extends perpendicular to said first and second projections;

two magnetic cores, each core formed by a plurality of laminated thin tapes, wherein each of said magnetic cores is positioned in a corresponding one of said recesses of said housing;

a winding positioned around said housings, said windings being positioned between said third projections such that said winding interlinks with said magnetic cores;

gap spacers interposed between opposed ends of said housing;

two non-magnetic covers, wherein each of said covers covers only the top of a corresponding one of said recesses, and wherein each of said non-magnetic covers has a fourth projection and fifth projections, said fourth and fifth projections extending outwardly from the surface of said cover;

two springs, wherein one of said springs is engaged with said first projections and wherein the other of said spring is engaged with said fourth projections, such that said pair of core halves are held together and said covers are held together; and a holder for mounting said inductor on a printed circuit board, said holder having a rectangular bottom wall, a plurality of pins extending from said wall, and four clips provided at the four corner of said bottom wall, said four clips engaging predetermined ones of said second and fifth projections.

2. An inductor according to claim 1, wherein said thin tape is amorphous tape.

* * * * *